United States Patent [19]

McGaffigan et al.

[11] Patent Number: 4,987,291

[45] Date of Patent: Jan. 22, 1991

[54] HEATER STRAPS

[75] Inventors: Thomas H. McGaffigan, Half Moon Bay; Rodney L. Derbyshire, Menlo Park; Douglas Wilkerson, Union City, all of Calif.

[73] Assignees: Metcal, Inc., Menlo Park, Calif.; AMP Incorporated, Middletown, Pa. ; a part interest

[21] Appl. No.: 436,757

[22] Filed: Nov. 15, 1989

[51] Int. Cl.[5] ..... H05B 3/58

[52] U.S. Cl. ..... 219/549; 219/504; 219/535

[58] Field of Search ..... 219/504, 505, 549, 526, 219/528, 535, 536

[56] References Cited

U.S. PATENT DOCUMENTS

| | | | |
|---|---|---|---|
| 2,998,840 | 9/1961 | Davis . | |
| 3,239,125 | 3/1966 | Sherlock . | |
| 4,204,316 | 5/1980 | Hummel | 219/535 |
| 4,256,945 | 3/1981 | Carter et al. . | |
| 4,623,401 | 11/1986 | Derbyshire et al. . | |
| 4,626,664 | 12/1986 | Grise | 219/525 |
| 4,659,912 | 4/1987 | Derbyshire . | |
| 4,695,712 | 9/1987 | Busch . | |
| 4,717,814 | 1/1988 | Krumme . | |
| 4,912,303 | 3/1990 | Beavers et al. | 219/535 |

*Primary Examiner*—Roy N. Envall, Jr.
*Attorney, Agent, or Firm*—Howard L. Rose

[57] ABSTRACT

An elongated flexible heater strip is provided having a transmission line section and a heater section employing a high mu material to control temperature at the Curie temperature of the high mu material; the above elements and a return buss being confined in a conductive sheath having a plurality of transverse slots to render the strap flexible, so that it may be cinched about a member to be heated; a strip of conductive material, such as copper, extending at least along the transmission line section interiorly of said sheath to reduce the resistance thereof and increase the current carrying capacity of the strap.

10 Claims, 2 Drawing Sheets

HEATER STRAPS

TECHNICAL FIELD

The present invention relates to heater straps and, more particularly, to high power heater straps employed for, among other uses, connecting braided shields of electrical cables to one another and to backshell adapters and the like.

BACKGROUND OF THE INVENTION

There is disclosed in U.S. Pat. Nos. 4,695,712 and 4,717,814 a quite thin, strap-like device that is a flexible heater employed to solder braids of electrical conductors or metal junctions to one another. These prior art straps have been sold, by the assignee cf the present invention, under the trademark "SOLDER STRAP" for about five years. The devices are comprised of a centrally located return buss, a high mu material located on one side and insulated from the return buss and an outer sheath. The sheath on the side of the return bus remote from the high mu material is transversely slotted to render the strap flexible, so that it may be wrapped about a pipe or braid.

The heater is usually provided with a latch and is adapted to cooperate with a tool that both cinches the strap and provides a constant current thereto. The heater extends along a length of the strap remote from the end that cooperates with the tool for only a distance necessary to surround the pipe or braid. A length of strap that extends from the tool to the heater region serves as a transmission line and does not include high mu material. This length of sheath is however transversely slotted along its entire length in order to impart flexibility. Also as the strap is cinched during use, the transmission line section folds easily upon itself without kinking, which might internally short out the strap. The currently available straps are limited, in the power that can be delivered to a load, to about 250 watts. Demands have developed for a higher wattage strap, but one in which the physical dimensions remain unchanged, and which operates at the same temperature.

Further, recent developments have indicated a potential need for a strap that operates at much higher temperatures, specifically braze temperatures. The present strap operates at solder temperatures of about 350° C. to 450° C., while braze temperatures are in the 700° C. to 850° C. range.

OBJECTS OF THE INVENTION

It is an object of the present invention to provide a heater strap of increased power delivery capabilities, relative to existing devices.

It is another object of the present invention to provide a heater strap of increased power delivery capabilities within an envelope developed for a lower wattage heater strap.

Yet another object of the present invention is to provide a heater strap for producing temperatures in the brazing temperature range, and employing the same basic configuration and concepts as the prior strap, with the modifications incorporated herein.

BRIEF DESCRIPTION OF THE INVENTION

Attempts to raise the energy delivered by the presently available heater strap may cause portions of the strap to overheat. It has been determined that the problem limiting the energy delivery capabilities of the present product resides in the transmission line region of the strap, that is, the region between the tool and the heater section. Ideally, this region of the strap acts as a transmission line and does not heat, but it does heat considerably since current can run only on the unslotted surface of the strap in this region. As this region heats, its temperature rises, and if the current is increased to raise the heater wattage by, say, 40%, the strap overheats and may self destruct.

It has been determined that if a thin conductive strip, for instance, copper, is inserted in the non-heater region of the strap, between the slotted side of the sheath and the insulated return bus, the resistance of the non-heating region is reduced sufficiently to permit at least a 55% increase in power delivery capabilities. The copper strip may be anchored at either end but preferably not both so that the copper may slip in the sheath, and not reduce flexilibity. The copper strip should also overlap the heater by perhaps a few eights of an inch so that there is not a discontinuity in the electrical path or in the stiffness of the strap.

An important feature of this structure is that the thickness of the conductive strip inserted as above, even though it permits a material increase in power, is still thin enough that none of the other components of the strap or tool must be altered.

Employing the above principles, but altering the overall size of the strap, permits development of a strap that is capable of delivering braze temperatures and energies. In such a strap, many of the materials must be changed as a result of the temperatures involved. Kapton, which may be used as the insulator in the prior straps, cannot withstand braze temperatures. Further, copper, which is used as the sheath material in the lower temperature straps, loses strength at braze temperatures and also must be replaced with a material of higher hot strength.

In a braze temperature strap, the Kapton is replaced by mica paper fiberglass tape, or other high temperature material. The copper sheath is replaced by nickel or stainless steel. The change in sheath material provides the necessary hot strength but degrades the electrical performance by increasing the resistivity in the non-heater portion of the strap. To correct this the copper buss of the instant invention must be added. The copper busses will oxidize at these temperatures, and if the strap is designed to be reusable, the exposed surfaces of the copper should be coated with a non-corrosive material. To further insure proper operating temperatures, the high mu material may have a copper backing, to enhance the change of resistance as the high mu material approaches Curie temperature. See U.S. Pat. No. 4,356,975.

The power delivered to the straps is determined by the standard power formula $P=I^2R$. If now the current is maintained constant then power is a function only of resistance of the heater, that is, $P=KR$. Absolute constant current is not required and the term "constant current", as used herein, obeys the formula $$\frac{\Delta|I|}{I} < -\frac{1}{2}\frac{\Delta|R|}{R}.$$

If I is a true constant, the temperature regulation is good. If I rises, but still satisfies the above equation, temperature regulation occurs, but it is not as good as if I remains fixed.

The term "effective Curie temperature" refers to the fact that a high mu material, a ferromagnetic, a ferrimagnetic, or other material that has effectively a Curie temperature, becomes roughly paramagnetic at a temperature below absolute Curie temperature. The variation may be only 1°, or may be as much as 100°, the essential point from the perspective of the present invention being that with the current being defined by the above equation, autoregulation will occur.

DETAILED DESCRIPTION OF THE INVENTION

Figure 1:
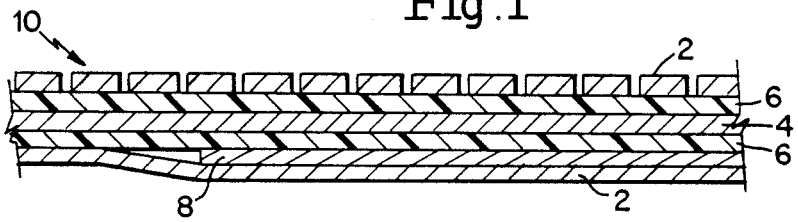
FIG. 1 is a side view in cross-section of a prior art heater strap.

Referring now, specifically, to FIG. 1 of the accompanying drawing, there is illustrated a side view in cross-section of a prior art strap. The strap comprises outer sheath 2, which surrounds the strap and, thus, shows as both the upper and lower layer in FIG. 1. Return buss 4 is enclosed within insulating layer 6 which, since it surrounds return buss 4, is shown as both an upper and lower layers. Layer 8 of high mu material, such as Alloy 42 or the like, is disposed between the bottom member of sheath 2 and insulating layer 6. The sheath 2 and return-buss 4 are connected by a staple that secures a latch to the end of the strap that includes the high mu material as is illustrated and described in FIG. 3. In operation, a constant current is applied between return buss 4 and sheath 2 at the other end of the strap, as described in more detail relative to FIG. 4.

Briefly, current flows through sheath 2 to the high mu material which current, due to skin effect and the proximity of return buss 4, is confined to a narrow region of the high mu layer adjacent return buss 4. The current path is completed through return buss 4. Upon the high mu material approaching effective Curie temperature, the current as a result of a decrease in skin effect, is no longer confined to a narrow region of the high mu layer and spreads out in layer 8, and if layer 8 is sufficiently thin, 1 to 2 skin depths, spreads into sheath 2. The resistance is reduced, and since current is constant, the heating effect decreases and temperature falls. Layer 8 now regains its permeability and temperature rises thus resulting in self-regulation in the region of the effective Curie temperature of layer 8.

In response to requests to increase the wattage of the strap by as much as 40%, the current to the strap was increased and the strap was destroyed. It was determined that region 10 of the strap, the region between the left end of the strap as viewed in FIG. 1, and the left end of layer 8, the transmission line section, was becoming excessively hot and self-destructing. Analysis determined that the increase in current increased heating of sheath 2 in the region 10 which increased its resistance so that the electrical power generated at this portion increased with increasing temperature, exceeding the maximum equilibrium temperature and thus producing failure of the strap.

Figure 2:
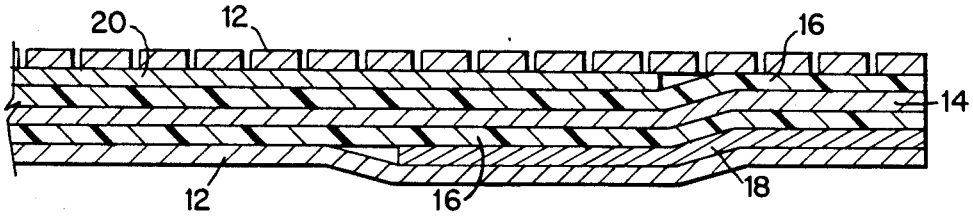
FIG. 2 is a side view in cross-section of a heater strap of the present invention.

Referring now, specifically, to FIG. 2 of the accompanying drawings, there is illustrated a first embodiment of the present invention. Again, there is provided outer sheath, reference numeral 12, return conductor 14 surrounded by insulating layer 16, and a short layer 18 of high mu material which constitutes the heater. Strip 20, preferably of copper or other highly conductive material, resides between the slotted surface of the sheath and the insulating layer 16 and extends from the left of the strap, as illustrated in FIG. 2, to a region overlapping layer 18.

Figure 3:
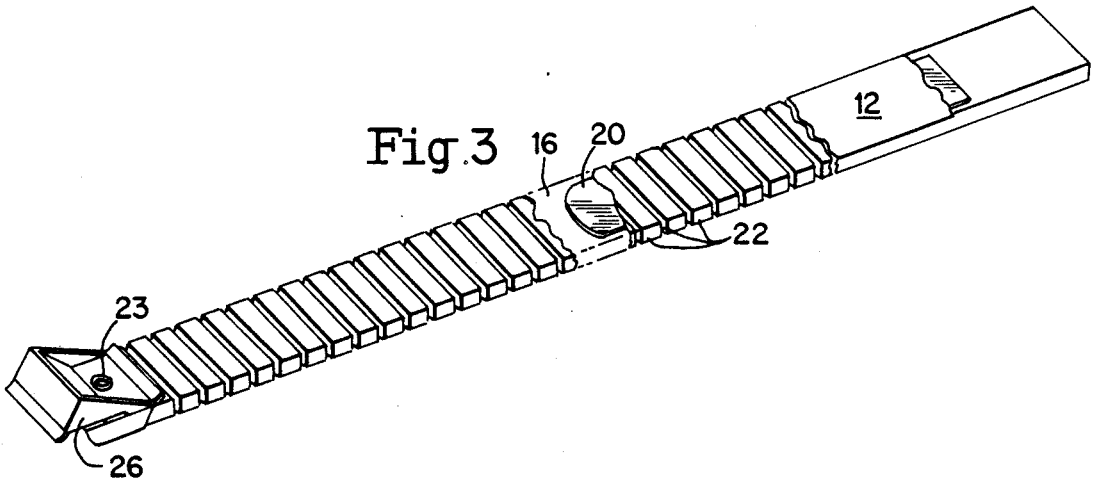
FIG. 3 is a partially cut-away view in perspective of the complete strap of FIG. 2.
Figure 4:
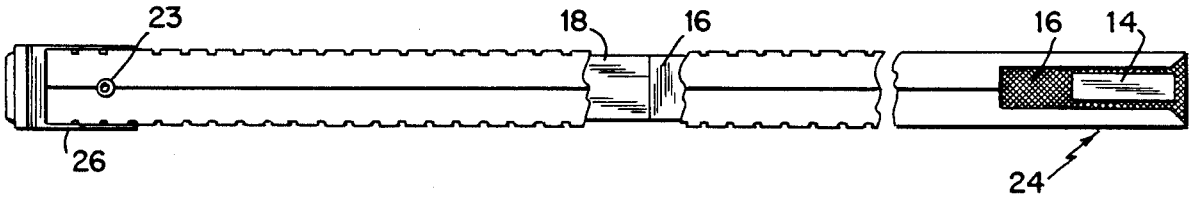
FIG. 4 is a partially cut-away view of the bottom of the strap of FIG. 3.

Referring to FIGS. 2, 3 and 4, layer 18 and strip 20 overlap so that ribs 22, extending down the sides of sheath 12, act as parallel side members or conductors 22, to carry current from strip 20 to high mu layer 18. The minimum overlap on a 350 watt strap has been found to be 0.20 inch. The overlap is a function of design for a specific purpose, and the overlap may span one or more of the ribs 22.

The interconnection between the return buss, the high mu material and the sheath of all of these devices is by means of an electrical conductive staple 23 that secures a latch 26 to the strap at the end containing the high mu material.

Referring to FIG. 4, the bottom of the strap of FIG. 3 is illustrated. Sheath 12 has no cross slots in the bottom, and is folded to provide a longitudinally extending seam down the middle. Center buss 14 is exposed, as at 24, by removing a short length of the sheath and a shorter length of insulation 16, which in this application is Nomex paper. Latch 26, as previously indicated, is secured to the left end of the strap, as viewed in FIGS. 3 and 4.

In operation, the right end of the strap is folded around overlapped braids or other members to be joined, and is passed through latch 26. The strap is cinched by a tool of the general type illustrated in FIGS. 7 and 8 of U.S. Pat. No. 4,695,712, and current is applied by the tool between exposed region 24 and sheath 12.

Figure 5:
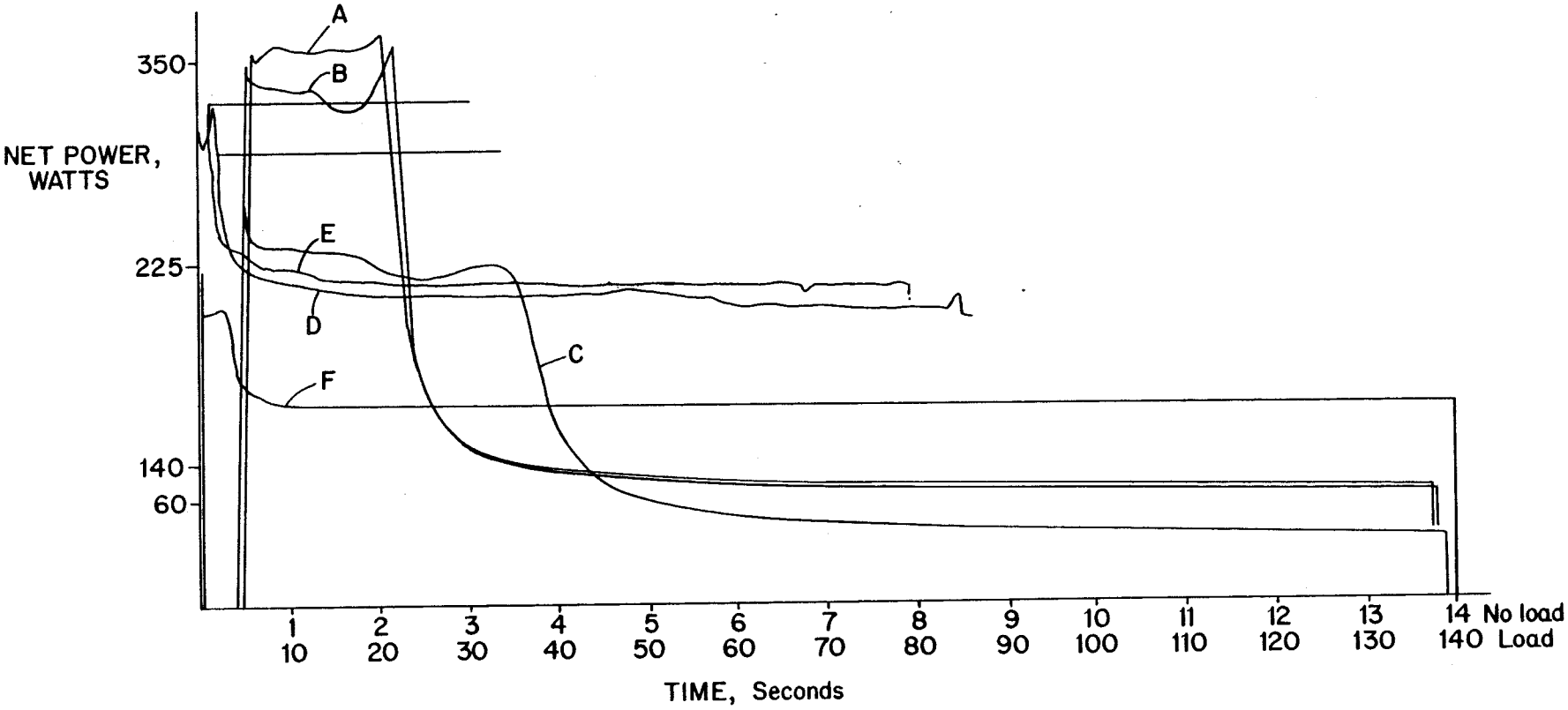
FIG. 5 illustrates a series of graphs comparing the performance of the prior art strap and the strap of the present invention.

Referring to the graphs of FIG. 5 of the accompanying drawings, there is illustrated a comparison of the performance of the prior art strap of FIG. 1 and the strap of FIG. 2. The graphs illustrated were made by a chart recorder operating at either 1 sec/inch or 10 sec/inch, as indicated. The graphs plot net power in watts, as a function of time. As a general comment, the graphs rise rapidly indicating that the strap is at a temperature below Curie temperature, and thus resistance is high and rapid heating occurs at the approximate maximum wattage available. Once the desired temperature is achieved, approximately the effective Curie temperature of the high mu material 18, the heater goes into its self regulation or idle mode, and wattage consumed falls rapidly. Thus, the graphs rise rapidly and fall rapidly, but rise more rapidly, since in the fall-off mode the effect is one of throttling down.

Graphs A and B illustrate the performance of the strap of the present invention under no-load conditions. It is noted that the watts delivered to the strap rise rapidly to about 350 watts in about half a second, and falls rapidly to about 60 watts in about 2½ seconds; the latter indicating that Curie temperature has been achieved, and the strap is in the idle mode, that is, maintaining an already achieved temperature. A strap of the prior design, also under no load, Graph C, rises to a wattage of about 250 watts in about half a second, but does not reach self regulating temperature until about 4 seconds. The difference between the maximum power peak and the idle power is the power available to perform a given task. In the instant invention maximum power is 350 watts and idle (the power required to maintain just the strap at temperature) is 60 watts. This gives 350 minus 60 or 290 watts available to do work. These figures contrasts with the prior art of 250–60 or 190 watts.

Referring now to performance of the straps under load, Graphs D and E are plots of the strap of the present invention employed to solder a braid to a backshell connector. With a load, the rise to full power delivery takes about one and a quarter seconds, and partial fall-off occurs in about 5 seconds. Full termination of the operation occurred in less than 80 seconds. With the prior art strap under the same load, Graph F, the delivery of maximum power occurred almost in the same time as the instant invention and partial fall-off occurred in about the same time as the strap of the invention. However, the operation was not complete until about 140 seconds. The power being delivered to the load in the instant invention was 220 watts versus 110 watts for the prior art strap. It should be kept in mind that both straps are at the same constant temperature. Thus, it is apparent that the strap of the present invention does deliver considerably more power than that of the prior design, without danger of burning up.

Figure 6:
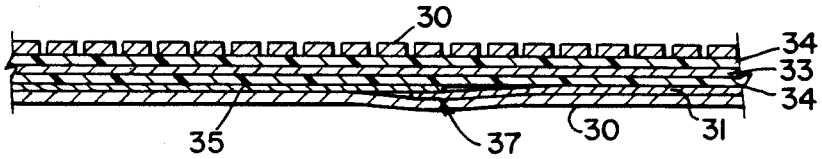
FIG. 6 is a side view of a second embodiment of the present invention.

Referring now specifically to FIG. 6 of the accompanying drawings, there is illustrated a strap that will achieve braze temperatures. Two approaches are taken in this embodiment of the invention. Other than for changes in materials to be discussed below, the copper strip may in one instance, extend the length of the strap and is located as in the prior embodiment, or, in a second instance, overlap and contact the high mu material or layer, the overlap being less than full length. In both embodiments also, a copper layer is formed on the high mu material adjacent sheath 30.

A basic change in the strap is the material of the sheath. Copper at 700°C.–800° C. has little mechanical strength and must be replaced by a material of greater strength such as non-magnetic nickel or stainless steels. These materials although stronger are of lower conductivity and thus if the basic design of strap of FIG. 1 were employed, the strap would seriously overheat. In order to obviate this problem the designs of FIGS. 6 and 7 are employed.

The device of FIG. 6 has an outer sheath 30 slotted at the bottom of the figure, heater 31 of high mu material, return buss 33, and conductive strip 35 that extends from the left end of the strap as viewed in FIG. 6 to region 37, where it overlaps heater 31.

Thus, strip 35 provides a low resistance path in parallel with the higher resistance path of sheath 30 to reduce resistance of the transmission line region to acceptable levels. In some instances of very heavy loads, the copper strip of FIG. 7 may also be employed.

Figure 7:
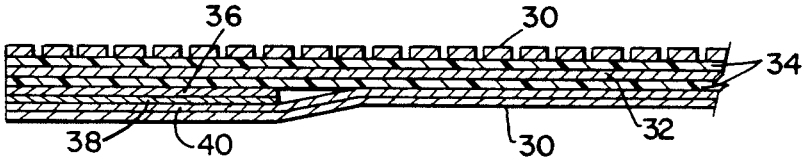
FIG. 7 is a side view of a modification of the second embodiment of the invention.

Referring specifically to FIG. 7 of the accompanying drawings, the slotted surface of sheath 30 is at the top of the figure. Return buss 32 is enclosed within a body 34 of insulation and a high mu layer 36 extends partially along the strap. The lower surface of layer 36 is in thermal and electrical contact with layer 38 of highly conductive material such as copper. A strip of highly conductive material 40, which again is preferably copper, extends the length of the strap, remote from the high mu material, and is anchored at one end, if flexibility is required.

The reason for employing extended copper strip 40 is that at the temperatures employed in brazing, sheath 30 must retain its strength at elevated temperatures, and thus copper, a preferred material cannot be employed to provide cinching of the strap. Nickel or stainless must be employed, and these are not as good conductors as copper. The use of the copper strip serves two functions. It provides the conductivity no longer provided by sheath 30, and at the same time solves the problem of overheating of the transmission line region of the strap by adding a parallel path to sheath 30, which is conductive in that region. If very high power is required a strip corresponding to the strip 20 of FIGS. 2 and 3 may also be employed.

Tests conducted with the strap of FIG. 6 produced temperatures as high as 750° C. without damage to the strap.

The foregoing description describes several embodiments which are intended to be illustrative of the many forms which the invention may assume. Other modifications and variations contained in the spirit of the following claims will be apparent to a person having ordinary skill in the art.

We claim:

1. An autoregulating heater, comprising:

a flexible, relatively flat, elongated autoregulating heater strap, having a first region in which resides a first member of high mu material, and a second region that serves as a transmission line between said first region and means for connecting said heater to a source of high frequency constant current, a return conductor lying adjacent to and insulated from said first member and extending beyond said first region at least into said second region, said return conductor and said first member being enveloped in a conductive sheath along their lengths, said conductive sheath having a surface slotted transversely to the length of the strap, a conductive strip extending along said second region and into at least the first region of said strap, said first member and said return conductor being electrically connected remote from said second region of said strap.

2. An autoregulating heater, as in claim 1, wherein:

said conductive strip is secured to said conductive sheath at one end of said strip only.

3. An autoregulating heater, as in claim 1, wherein:

said conductive strip is in electrical contact with said surface of said conductive sheath.

4. An autoregulating heater, as in claim 1, wherein:

said conductive strip extends the length of said strap.

5. An autoregulating heater, as in claim 1, wherein:

said strip is in direct contact with a length of said first member.

6. An autoregulating heater, as in claim 1, wherein:

said conductive array is an elongated conductive member folded about and forming the outer surface of said elongated strap, said elongated conductive member providing a continuous surface adjacent to and in electrical and thermal contact with said first member, said strip of conductive material having a second surface opposed to said continuous surface, said second surface having transverse narrow slots along its length.

7. An autoregulating heater, as in claim 6, wherein:

said conductive strip is connected in parallel with said second surface.

8. An autoregulating heater, as in claim 6, wherein:

said conductive strip is connected in parallel with said first surface.

9. An autoregulating heater, as in claim 1, further comprising:

a conductive surface formed on said first member remote from said return conductor.

10. An autoregulating heater, as in claim 6, further comprising:

a conductive surface formed on said first member and in contact with said first surface.

* * * * *